US010962010B2

(12) United States Patent
Moon et al.

(10) Patent No.: US 10,962,010 B2
(45) Date of Patent: Mar. 30, 2021

(54) COMPRESSOR

(71) Applicant: LG ELECTRONICS INC., Seoul (KR)

(72) Inventors: Seokhwan Moon, Seoul (KR); Bumdong Sa, Seoul (KR); Byeongchul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 99 days.

(21) Appl. No.: 15/510,401

(22) PCT Filed: Sep. 2, 2015

(86) PCT No.: PCT/KR2015/009227
§ 371 (c)(1),
(2) Date: Mar. 10, 2017

(87) PCT Pub. No.: WO2016/043455
PCT Pub. Date: Mar. 24, 2016

(65) Prior Publication Data

US 2017/0306961 A1 Oct. 26, 2017

(30) Foreign Application Priority Data

Sep. 19, 2014 (KR) ..... 10-2014-0125140

(51) Int. Cl.
*F04C 29/00* (2006.01)
*F04C 18/356* (2006.01)
*F04C 23/00* (2006.01)

(52) U.S. Cl.
CPC ..... *F04C 29/0021* (2013.01); *F04C 18/356* (2013.01); *F04C 18/3566* (2013.01);
(Continued)

(58) Field of Classification Search
CPC ..... F04C 18/0215
(Continued)

(56) References Cited

U.S. PATENT DOCUMENTS 4,086,042 A * 4/1978 Young ..... F01C 21/0881 418/139
4,296,500 A * 10/1981 Monties ..... F04C 2/22 128/899

(Continued)

FOREIGN PATENT DOCUMENTS

BE 528 493 5/1954
CN 2198419 5/1995

(Continued)

OTHER PUBLICATIONS

International Search Report dated Nov. 26, 2015 issued in Application No. PCT/KR2015/009227.

(Continued)

*Primary Examiner* — Peter J Bertheaud
*Assistant Examiner* — Geoffrey S Lee
(74) *Attorney, Agent, or Firm* — Ked & Associates LLP

(57) ABSTRACT

A compressor having a torque load reducing unit to move a center of weight to which a gas force is applied is provided. As the torque load reducing unit is formed at an oval-shaped roller, a distance between a rotation center of the roller and an operation point to which a gas force is applied is shortened. This may reduce a torque load to the roller, and may enhance a compression efficiency.

13 Claims, 9 Drawing Sheets

(52) U.S. Cl.
CPC ..... *F04C 29/005* (2013.01); *F04C 23/008* (2013.01); *F04C 2250/20* (2013.01); *F04C 2270/03* (2013.01)

(58) Field of Classification Search
USPC ..... 417/410.1
See application file for complete search history.

(56) References Cited

U.S. PATENT DOCUMENTS

| | | | | |
|---|---|---|---|---|
| 4,345,886 | A * | 8/1982 | Nakayama | F04C 18/3566 418/100 |
| 4,551,073 | A * | 11/1985 | Schwab | F04C 2/22 417/352 |
| 4,802,830 | A * | 2/1989 | Nakajima | F01C 21/106 418/150 |
| 6,213,732 | B1 * | 4/2001 | Fujio | F04C 18/3564 181/403 |
| 7,306,440 | B2 | 12/2007 | Amano | |
| 7,467,935 | B2 | 12/2008 | Betz et al. | |
| 7,500,463 | B2 * | 3/2009 | Shuba | F01C 1/3446 123/229 |
| 8,323,009 | B2 * | 12/2012 | Shimizu | F04C 15/0042 418/11 |
| 2006/0099099 | A1 | 5/2006 | Amano | |
| 2010/0296959 | A1 * | 11/2010 | Shimizu | F04C 15/0042 418/204 |
| 2011/0076169 | A1 * | 3/2011 | Coffey | F04C 18/356 417/410.1 |
| 2015/0030492 | A1 * | 1/2015 | Montie | F01C 21/106 418/260 |

FOREIGN PATENT DOCUMENTS

| | | |
|---|---|---|
| CN | 1626814 | 6/2005 |
| CN | 102597525 | 7/2012 |
| CN | 102788019 | 11/2012 |
| CN | 103511258 | 1/2014 |
| CN | 203685578 | 7/2014 |
| FR | 2 275 664 | 2/1979 |
| JP | 58-217791 | 12/1983 |
| JP | 10-122172 | 5/1998 |
| JP | 10-220238 | 8/1998 |
| JP | 2007-321559 | 12/2007 |

OTHER PUBLICATIONS

Chinese Office Action dated Mar. 21, 2018 (Translation).
European Search Report dated Apr. 11, 2018.
Chinese Office Action dated Dec. 3, 2018 with English Abstract.

* cited by examiner

COMPRESSOR

CROSS-REFERENCE TO RELATED APPLICATIONS

This application is a U.S. National Stage Application under 35 U.S.C. § 371 of PCT Application No. PCT/KR2015/009227, filed on Sep. 2, 2015, which claims priority to Korean Patent Application No. 10-2014-0125140, filed on Sep. 19, 2014, whose entire disclosures are hereby incorporated by reference.

TECHNICAL FIELD

The present invention relates to a compressor, and more particularly, to a compressor having an oval-shaped roller.

BACKGROUND ART

Generally, a compressor may be classified into a rotary type compressor and a reciprocating type compressor according to a refrigerant compression method. In the rotary type compressor, a volume of a compression space is varied as a piston performs a rotary motion or an orbiting motion in a cylinder. On the other hand, in the reciprocating type compressor, a volume of a compression space is varied as a piston performs a reciprocating motion in a cylinder. As the rotary compressor, a rotary compressor for compressing a refrigerant as a piston is rotated by using a rotational force of a motor part is well-known.

The rotary compressor is configured to compress a refrigerant using a rolling piston which executes an eccentric rotary motion at a compression space of a cylinder, and a vane for dividing the compression space of the cylinder into a suction chamber and a discharge chamber by contacting an outer circumferential surface of the rolling piston.

Such a rotary compressor may be classified into a single rotary compressor and a double rotary compressor according to the number of compression spaces. The double rotary compressor may include a type for forming a plurality of compression spaces by laminating cylinders each having a single compression space on each other, and a type for forming a plurality of compression spaces at a single cylinder. In the former case, a plurality of eccentric portions are formed at a rotational shaft with height differences, and are configured to alternately compress a refrigerant at two compression spaces and to discharge the compressed refrigerant, while the eccentric portions perform an eccentric rotary motion at the compression space of each cylinder. On the contrary, in the latter case, as shown in FIG. 1, a refrigerant is simultaneously compressed at two compression spaces V1 and V2 and then is discharged, while a roller performs a concentric rotary motion at a single cylinder 3 provided with an oval-shaped roller 2 at a rotational shaft 1. In the latter case, since the refrigerant is sucked, compressed and discharged in the two compression spaces V1 and V2 with the same phase, gas forces transmitted to a central region of the rotational shaft 1 are attenuated. As a result, a repulsive force in a radial direction may almost disappear, and vibration noise of the compressor may be reduced.

DISCLOSURE OF INVENTION

Technical Problem

However, the conventional rotary compressor having such an oval-shaped roller may have the following problems.

As shown in FIG. 1, as the shape of the roller 2 is changed from a circular shape to an oval shape (elliptical shape), a center of weight to which a gas force is applied, i.e., an operation point by a gas force (F) (hereinafter, will be referred to as a gas force weight center) (C) is moved to two wing portions of the oval-shaped roller. As a result, a distance between a rotation center of the rotational shaft (hereinafter, will be also referred to as a 'rotation center of the roller') (O) and the gas force weight center (C) (hereinafter, will be referred to as a weight center distance) (r) becomes far. This may cause a torque load to be increased, resulting in lowering of compression efficiency.

Solution to Problem

Therefore, an object of the present invention is to provide a compressor capable of reducing a torque load of an oval-shaped roller.

Another object of the present invention is to provide a compressor capable of reducing a distance between a gas force weight center (a center of weight to which a gas force is applied) and a rotation center of a roller.

To achieve these and other advantages and in accordance with the purpose of the present invention, as embodied and broadly described herein, there is provided a compressor, including: a driving motor; a rotational shaft configured to transmit a rotational force of the driving motor; a cylinder installed at one side of the driving motor; a roller having an outer circumferential surface contacting an inner circumferential surface of the cylinder on at least two points, rotated by being provided at the rotational shaft, and concentric with the cylinder; and at least two vanes movably provided at the cylinder, contacting an outer circumferential surface of the roller, and configured to divide at least two compression spaces formed by the cylinder and the roller into a suction chamber and a compression chamber, wherein the roller is provided with a torque load reducing unit configured to move a center of weight to which a gas force is applied by the roller.

The torque load reducing unit may be formed to be positioned on a long-axis direction central line of the roller at least partially, the long-axis direction central line which connects a plurality of contact points between the outer circumferential surface of the roller and the inner circumferential surface of the cylinder with each other.

The torque load reducing unit may be formed to be symmetrical to each other, based on a long-axis direction central line of the roller, the long-axis direction central line which connects a plurality of contact points between the outer circumferential surface of the roller and the inner circumferential surface of the cylinder with each other.

The torque load reducing unit may be formed to be asymmetrical to each other, based on a long-axis direction central line of the roller, the long-axis direction central line which connects a plurality of contact points between the outer circumferential surface of the roller and the inner circumferential surface of the cylinder with each other.

The torque load reducing unit may be formed such that its geometrical center is positioned at a front side of the long-axis direction central line of the roller, assuming that a rotation direction of the roller based on the long-axis direction central line is towards the front side.

A long-axis diameter of a virtual oval which connects two ends of an outer wall surface of the torque load reducing unit with each other, may be formed to be larger than a diameter of the rotational shaft, but smaller than a long-axis diameter of the roller.

An outer wall surface of the torque load reducing unit may be spaced from the outer circumferential surface of the roller by a predetermined sealing distance. And a long-axis diameter of the torque load reducing unit may be formed to be larger than or equal to a value obtained by adding the sealing distance to a diameter of the rotational shaft, but smaller than or equal to a value obtained by deducting the sealing distance from a long-axis diameter of the roller.

A short-axis diameter of a virtual oval which connects two ends of the outer wall surface of the torque load reducing unit with each other, may be formed to be larger than a diameter of the rotational shaft, but smaller than a short-axis diameter of the roller.

The outer wall surface of the torque load reducing unit may be spaced from the outer circumferential surface of the roller by a predetermined sealing distance. And a short-axis diameter of the torque load reducing unit may be formed to be larger than or equal to a value obtained by adding the sealing distance to the diameter of the rotational shaft, but smaller than or equal to a value obtained by deducting the sealing distance from the short-axis diameter of the roller.

A maximum interval between an outer wall surface and an inner wall surface of the torque load reducing unit may be formed to be larger than zero, but to be smaller than a half of a value obtained by deducing a diameter of the rotational shaft from a long-axis diameter of the roller.

The outer wall surface of the torque load reducing unit may be spaced from the outer circumferential surface of the roller by a predetermined sealing distance. And the maximum interval between the outer wall surface and the inner wall surface of the torque load reducing unit may be formed to be larger than zero, but to be smaller than or equal to a half of a value obtained by deducing the sealing distance and the diameter of the rotational shaft from the long-axis diameter of the roller.

According to another aspect of the present invention, there is provided a compressor, including: a driving motor; a rotational shaft configured to transmit a rotational force of the driving motor; a cylinder installed at one side of the driving motor; a roller having an outer circumferential surface contacting an inner circumferential surface of the cylinder on at least two points, rotated by being provided at the rotational shaft, and concentric with the cylinder; and at least two vanes movably provided at the cylinder, contacting an outer circumferential surface of the roller, and configured to divide at least two compression spaces formed by the cylinder and the roller into a suction chamber and a compression chamber, wherein the roller is provided with a torque load reducing unit configured to move a center of weight to which a gas force is applied, toward a rotation center of the roller, and wherein assuming that the long-axis direction central line of the roller which connects two contact points of the roller contacting the inner circumferential surface of the cylinder is perpendicular to a virtual line which connects a lengthwise central line of the two vanes, a distance between a geometrical center of the torque load reducing unit and the rotation center is equal to or larger than a distance between the center of weight and the rotation center.

According to another aspect of the present invention, there is provided a compressor, including: a driving motor; a rotational shaft configured to transmit a rotational force of the driving motor; a cylinder installed at one side of the driving motor; a roller having an outer circumferential surface contacting an inner circumferential surface of the cylinder on at least two points, rotated by being provided at the rotational shaft, and concentric with the cylinder; and at least two vanes movably provided at the cylinder, contacting an outer circumferential surface of the roller, and configured to divide at least two compression spaces formed by the cylinder and the roller into a suction chamber and a compression chamber, wherein assuming that the long-axis direction central line of the roller which connects two contact points of the roller contacting the inner circumferential surface of the cylinder is perpendicular to a virtual line which connects a lengthwise central line of the two vanes, a distance between the center of weight to which a gas force is applied by the roller and the rotation center of the roller is larger than or equal to (0.0749×the long-axis diameter of the roller), but smaller than or equal to (0.212×the long-axis diameter of the roller).

According to another aspect of the present invention, there is provided a compressor, including: a driving motor; a rotational shaft configured to transmit a rotational force of the driving motor; a cylinder installed at one side of the driving motor; a roller having an outer circumferential surface contacting an inner circumferential surface of the cylinder on at least two points, rotated by being provided at the rotational shaft, and concentric with the cylinder; and at least two vanes movably provided at the cylinder, contacting an outer circumferential surface of the roller, and configured to divide at least two compression spaces formed by the cylinder and the roller into a suction chamber and a compression chamber, wherein the roller and the rotational shaft are formed of different materials, and the roller is formed to have a lower density than the rotational shaft.

Advantageous Effects of Invention

The compressor of the present invention can have the following advantages.

As the torque load reducing unit is formed at the oval-shaped roller, a distance between the rotation center of the roller and the center of weight (operation point) to which a gas force is applied becomes short. This can reduce a torque load to the roller, and can enhance compression efficiency.

BEST MODE FOR CARRYING OUT THE INVENTION

Reference will now be made in detail to the preferred embodiments of the present invention, examples of which are illustrated in the accompanying drawings. It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

Description will now be given in detail of a compressor according to an embodiment, with reference to the accompanying drawings.

Figure 1:
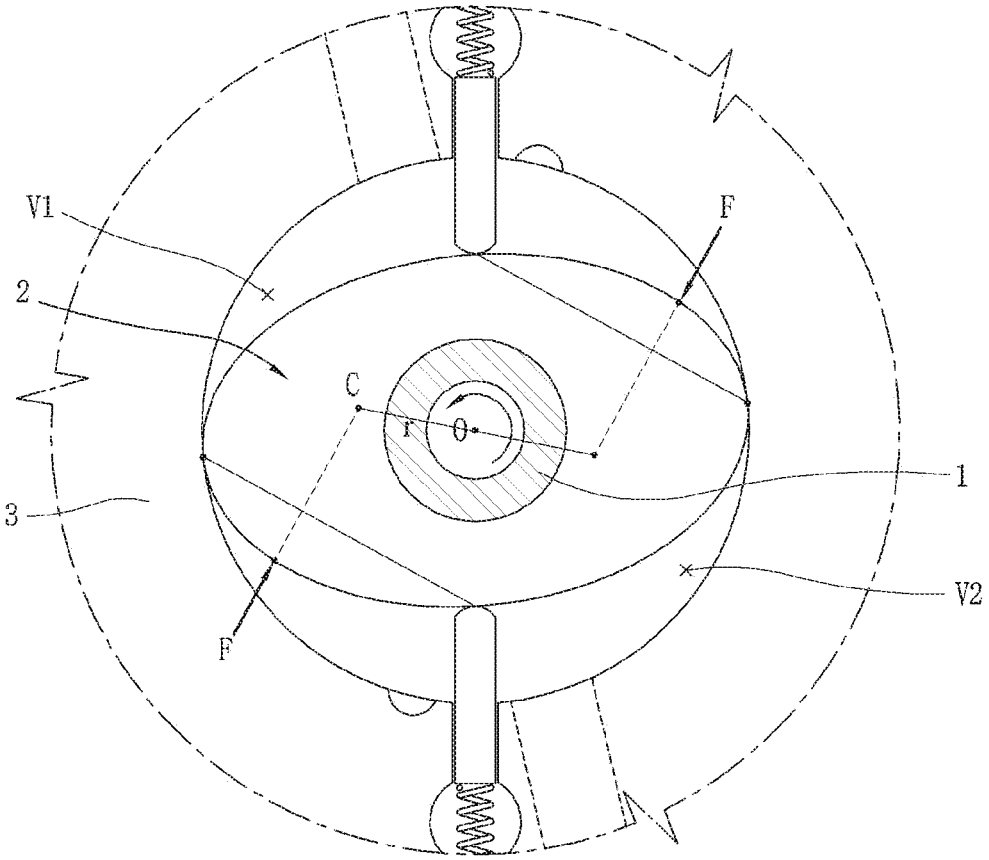
FIG. 1 CONVENTIONAL ART
FIG. 1 is a planar view illustrating a compression part of a rotary compressor having an oval-shaped roller in accordance with the conventional art.
Figure 2:
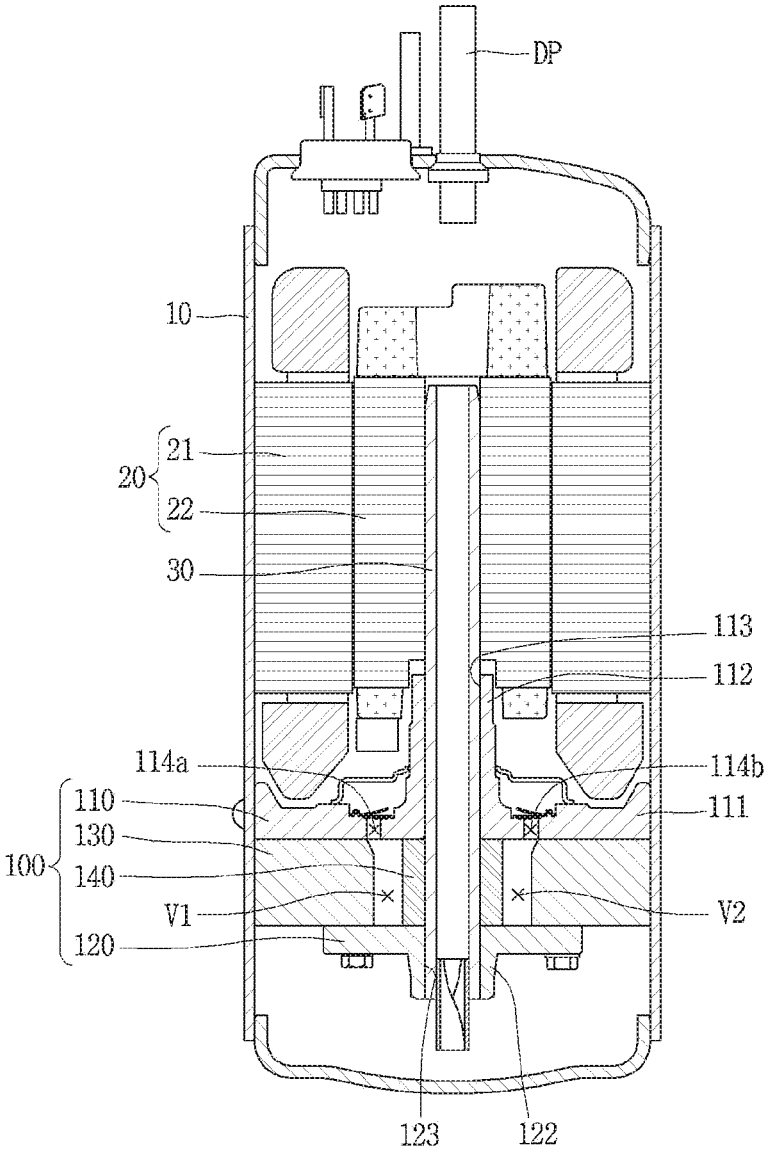
FIG. 2 is a longitudinal sectional view of a rotary compressor according to the present invention.
Figure 3:
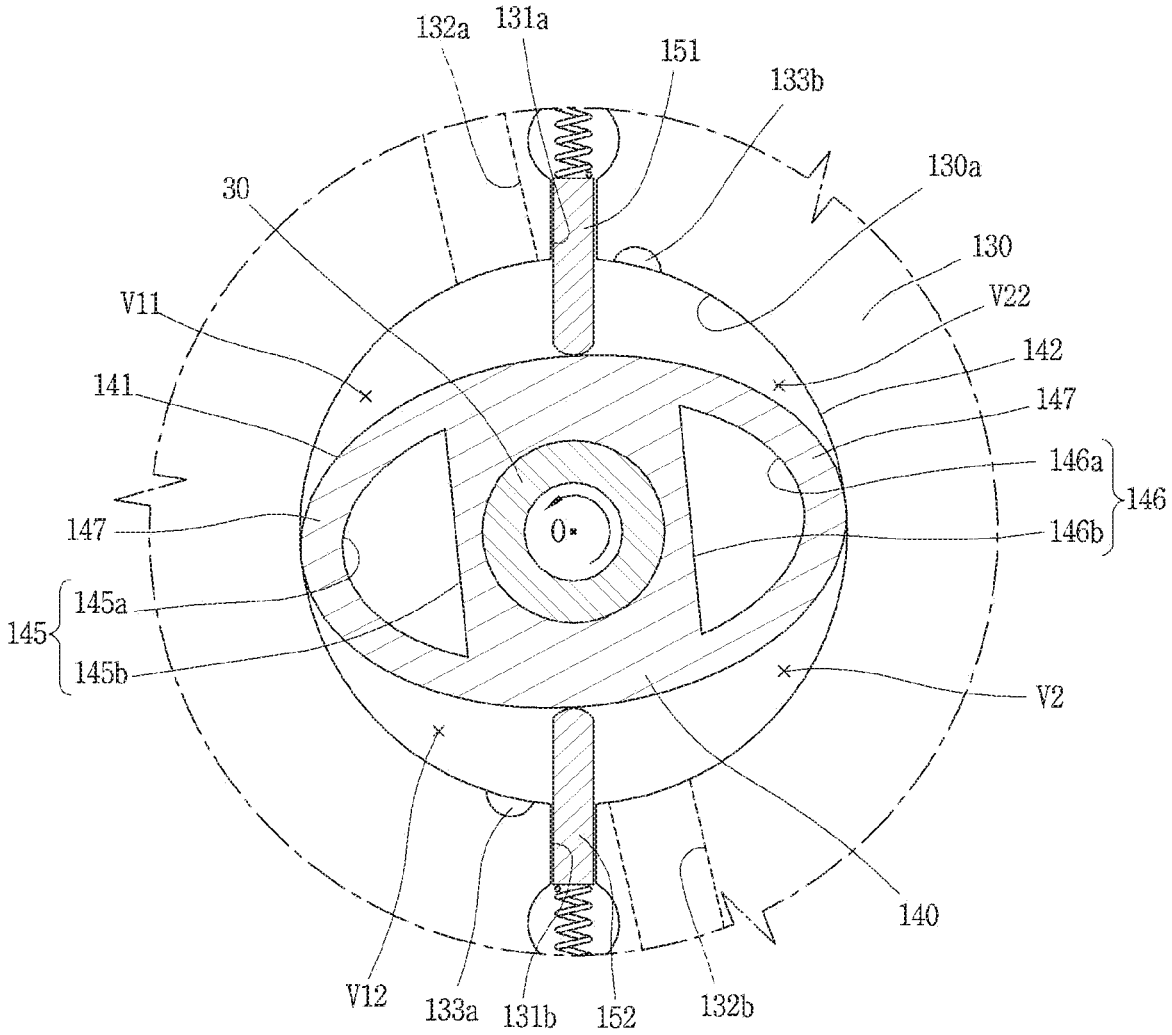
FIG. 3 is an exploded perspective view of a compression part of the rotary compressor of FIG. 2.
Figure 4:
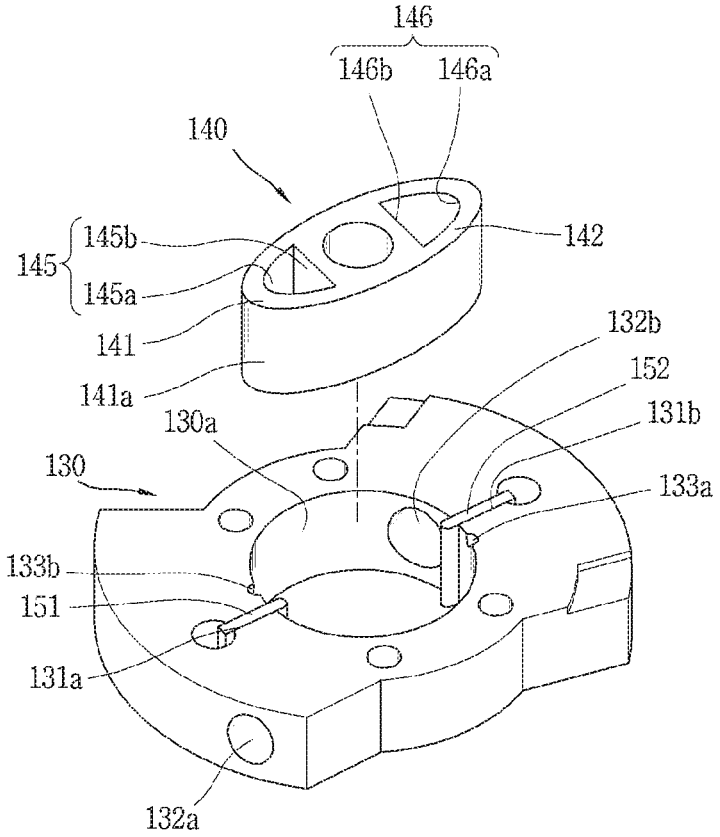
FIG. 4 is a planar view of the compression part of the rotary compressor of FIG. 2.
Figure 5:
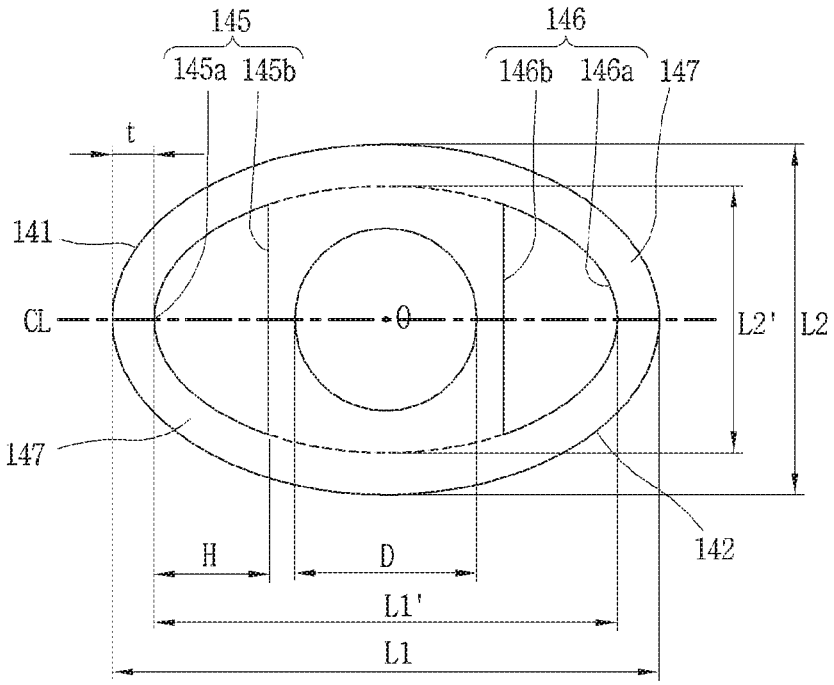
FIG. 5 is a schematic view illustrating a standard of a torque load reducing unit in a roller of FIG. 4.

FIG. 2 is a longitudinal sectional view of a rotary compressor according to the present invention. FIG. 3 is an exploded perspective view of a compression part of the rotary compressor of FIG. 2. FIG. 4 is a planar view of the compression part of the rotary compressor of FIG. 2. FIG. 5 is a schematic view illustrating a standard of a torque load reducing unit in a roller of FIG. 4.

As shown, in a rotary compressor according to an embodiment of the present invention, a motor part 20 may be installed in a casing 10, and a compression part 100 mechanically connected to the motor part 20 by a rotational shaft 30 may be installed below the motor part 20.

The motor part 20 may include a stator 21 forcibly-fixed to an inner circumferential surface of the casing 10, and a rotor 22 rotatably inserted into the stator 21. The rotational shaft 30 may be forcibly-coupled to the rotor 22.

The compression part 100 may include a main bearing 110 and a sub bearing 120 configured to support the rotational shaft 30; a cylinder 130 installed between the main bearing 110 and the sub bearing 120, and forming a compression space; a roller 140 formed at the rotational shaft 30, and performing a rotary motion at a compression space (V) of the cylinder 130; and a vane 150 contacting an outer circumferential surface of the roller 140, and movably-coupled to the cylinder 130. The roller 140 may contact an inner circumferential surface 130*a* of the cylinder 130 on at least two points, thereby dividing the compression space (V) of the cylinder 130 into at least two regions. And the vane 150 may be provided in at least two in number, thereby dividing each of the at least two compression spaces into a suction chamber and a compression chamber. Hereinafter, a compression part having two compression spaces will be explained.

The main bearing 110 is formed to have a disc shape, and a side wall portion 111 may be formed at an edge of the main bearing 110 so as to be shrinkage-fit or welded to an inner circumferential surface of the casing 10. A main shaft accommodating portion 112 may upward protrude from a central part of the main bearing 110, and a shaft accommodating hole 113 for inserting and supporting the rotational shaft 30 may be penetratingly-formed at the main shaft accommodating portion 112. A first discharge opening 114*a* and a second discharge opening 114*b*, connected to a first compression space (V1) and a second compression space (V2) to be explained later and configured to discharge a refrigerant compressed in the compression spaces V1 and V2 into an inner space 11 of the casing 10, may be formed at one side of the main shaft accommodating portion 112. The first discharge opening 114*a* and the second discharge opening 114*b* may be formed in a circumferential direction with an interval of 180°. In some cases, the first discharge opening 114*a* and the second discharge opening 114*b* may be formed at a sub bearing 120.

The sub bearing 120 may be formed to have a disc shape, and may be bolt-coupled to the main bearing 110 together with the cylinder 130. When the cylinder 130 is fixed to the casing 10, the sub bearing 120 may be bolt-coupled to the cylinder 130 together with the main bearing 110. On the other hand, when the sub bearing 120 is fixed to the casing 10, both the cylinder 130 and the main bearing 110 may be bolt-coupled to the sub bearing 120.

A sub shaft accommodating portion 122 may downward protrude from a central part of the sub bearing 120, and a shaft accommodating hole 123 for supporting a lower end of the rotational shaft 30 may be penetratingly-formed at the sub shaft accommodating portion 122, in a concentric manner to the shaft accommodating hole 113 of the main bearing 110.

As shown in FIGS. 3 and 4, an inner circumferential surface 130*a* of the cylinder 130 may have a ring shape of a right circle. A first vane slot 131*a* and a second vane slot 131*b*, into which a first vane 151 and a second vane 152 to be explained later are movably inserted, may be formed at two sides of an inner circumferential surface of the cylinder 130, in a radial direction. The first vane slot 131*a* and the second vane slot 131*b* may be formed in a circumferential direction with an interval of 180°.

A first suction opening 132*a* and a second suction opening 132*b* may be formed at one side of the first vane slot 131*a* and the second vane slot 131*b*, in a circumferential direction. The first suction opening 132*a* and the second suction opening 132*b* may be formed in a circumferential direction with an interval of 180°. The first suction opening 132*a* and the second suction opening 132*b* may be formed at the cylinder 130. However, in some cases, the first suction opening 132*a* and the second suction opening 132*b* may be formed at the sub bearing or the main bearing.

A first discharge guide groove 133*a* and a second discharge guide groove 133*b* may be formed at another side of the first vane slot 131*a* and the second vane slot 131*b* in a circumferential direction, in correspondence to the first discharge opening 114*a* and the second discharge opening 114*b* of the main bearing, respectively. The first discharge guide groove 133*a* and the second discharge guide groove 133*b* may be formed in a circumferential direction with an interval of 180°. In some cases, the first discharge guide groove 133*a* and the second discharge guide groove 133*b* may not be formed.

As shown in FIGS. 3 and 4, the roller 140 may be integrally formed at the rotational shaft 30, or may be coupled to the rotational shaft 30 after being separately fabricated. The roller 140 may be provided with a first wing portion 141 and a second wing portion 142 long-extending to right and left directions. The first wing portion 141 and the second wing portion 142 may be formed to be symmetrical to each other in a circumferential direction with an interval of 180°. Hereinafter, the first wing portion will be explained.

The first wing portion 141 may be formed to have an oval-shape such that its outer circumferential surface point-contacts the inner circumferential surface 130*a* of the cylinder 130. However, if the first wing portion point-contacts the inner circumferential surface 130*a* of the cylinder 130, it may be difficult to form an oil film between the first wing portion and the cylinder, due to a narrow lubrication area. Accordingly, the first wing portion may be formed such that its outer circumferential surface surface-contacts the inner circumferential surface 130*a* of the cylinder 130.

A torque load reducing unit 145, configured to reduce a torque load generated due to an eccentric state of the first wing portion 141, may be formed at the first wing portion 141. The torque load reducing unit 145 may be formed at only the first wing portion 141. However, in this case, vibrations from the compressor may be increased due to a weight difference between the two wing portions. Accordingly, it is preferable to form the torque load reducing unit 145 at both the first wing portion 141 and the second wing portion 142. Preferably, the torque load reducing unit formed at the first wing portion 141 (hereinafter, will be referred to as a 'first torque load reducing unit') 145, and the torque load reducing unit formed at the second wing portion 142 (hereinafter, will be referred to as a 'second torque load reducing unit') 146 are symmetrical to each other based on the rotation center (O) of the rotational shaft 30. In a case where the first wing portion and the second wing portion are formed to have different densities, the torque load reducing units may be formed at only the wing portion having a relatively higher density.

The first torque load reducing unit 145 may be formed to have various shapes. For instance, as shown in FIGS. 3 and 4, the first torque load reducing unit 145 may be formed to have a semi-circular shape. That is, the first torque load reducing unit 145 may include an outer wall surface 145*a* formed to have a curved surface, and an inner wall surface 145*b* for connecting two ends of the outer wall surface 145*a* by a straight line.

For the same sealing distance (t), the outer wall surface 145*a* of the first torque load reducing unit 145 is formed to have the same curvature as the outer circumferential surface of the first wing portion 141. That is, when the outer wall surface 145*a* of the first torque load reducing unit 145 has a curvature larger or smaller than that of the first wing portion 141, the sealing distance (t) from the outer circumferential surface of the first wing portion 141, to the outer wall surface 145*a* of the first torque load reducing unit 145 is not uniform. As a result, a refrigerant compressed in the compression spaces V1 and V2 may be partially introduced into the first torque load reducing unit 145*a* which forms a space portion, at a region having a relatively short sealing distance (t). If the outer circumferential surface of the first wing portion 141 has a different curvature from the outer wall surface 145*a* of the first torque load reducing unit 145, the sealing distance should be excessively increased at a region rather than the region having a minimized sealing distance, for a proper value of the minimum sealing distance. This may restrict a volume of the first torque load reducing unit. As a result, there is a limitation in reducing a distance between a center of weight to which a gas force is applied and the rotation center of the roller (hereinafter, will be referred to as a 'weight center distance'). FIG. 5 illustrates that a virtual line (indicated by the dotted line) has the same curvature as the outer circumferential surface of the roller, the virtual line which connects outer wall surfaces of the first torque load reducing unit and the second torque load reducing unit with each other. In the roller of FIG. 5, a sealing portion 147 is formed outside the first torque load reducing unit 145 and the second torque load reducing unit 146. And a width of the sealing portion 147, i.e., the sealing distance (t) with respect to the first torque load reducing unit 145 and the second torque load reducing unit 146 may be formed constantly. Accordingly, a volume of the first torque load reducing unit 145 and the second torque load reducing unit 146 may be maximized, and thus a weight center distance may be reduced.

The first torque load reducing unit 145 and the second torque load reducing unit 146 may be formed as holes which penetrate the first wing portion 141 and the second wing portion 142 in a shaft direction. Alternatively, the first torque load reducing unit 145 and the second torque load reducing unit 146 may be formed as grooves formed at upper and lower side surfaces of the roller with a predetermined depth, the roller which forms a shaft direction bearing surface by contacting the main bearing 110 and the sub bearing 120.

The first torque load reducing unit 145 and the second torque load reducing unit 146 may be formed independently as shown in the drawings. Alternatively, the first torque load reducing unit 145 and the second torque load reducing unit 146 may be formed as one member as two ends thereof are connected to each other.

The vane 150 may include a first vane 151 slidably-inserted into the first vane slot 131*a*, and a second vane 152 slidably-inserted into the second vane slot 131*b*. The first vane 151 and the second vane 152 may be formed in a circumferential direction with an interval of 180° like the first vane slot 131*a* and the second vane slot 131*b*. With such a configuration, the first vane 151 divides a suction chamber (V11) of the first compression space (V1) and a compression chamber (V22) of the second compression space (V2) from each other, and the second vane 152 divides a suction chamber (V21) of the second compression space (V2) and a compression chamber (V12) of the first compression space (V1) from each other.

Effects of the rotary compressor according to an embodiment are as follows.

If the rotor 22 of the motor part 20 and the rotational shaft 30 coupled to the rotor 22 rotate as a power is supplied to the motor part 20, the roller 140 rotates together with the rotational shaft 30, and thus a refrigerant is simultaneously sucked into the first compression space (V1) and the second compression space (V2) of the cylinder 130. The refrigerant is simultaneously compressed by the roller 140, the first vane 151, and the second vane 152, and is simultaneously discharged to the inner space 11 of the casing 10 through the first discharge opening 114*a* and the second discharge opening 114*b* of the main bearing 110. Such a compression operation and a discharge operation are repeatedly performed.

With such a configuration, a refrigerant is simultaneously compressed in the first compression space (V1) and the second compression space (V2), so gas forces transmitted to a central part of the rotational shaft are attenuated. As a result, a repulsive force in a radial direction may become almost zero, and thus vibrations of the compressor may be significantly reduced.

Figure 6:
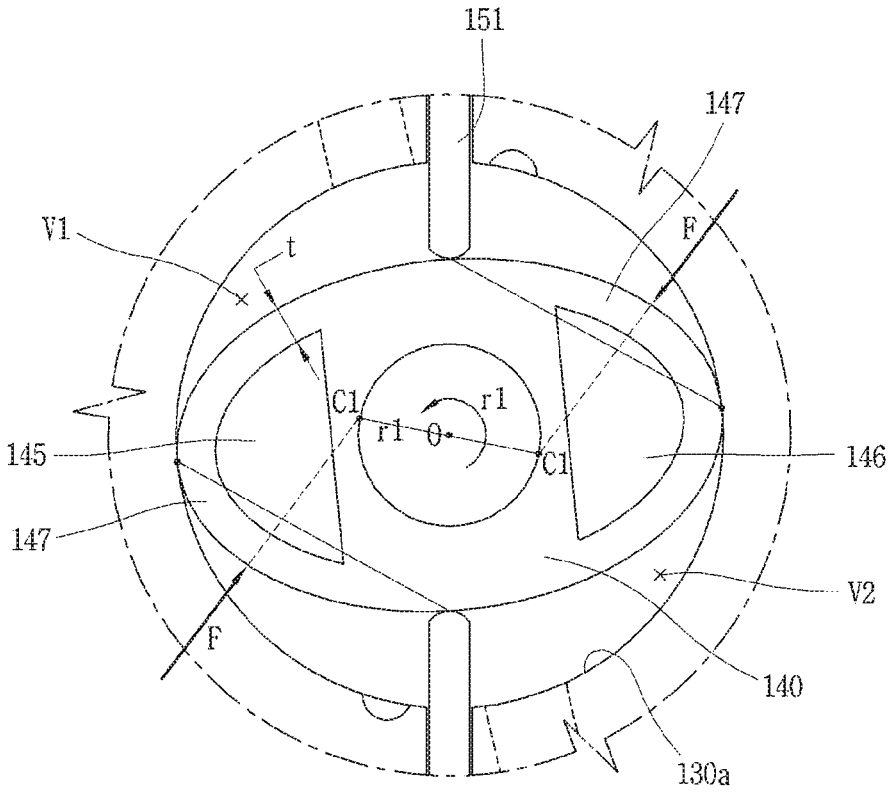
FIG. 6 is a schematic view illustrating a weight center distance (a distance between a center of weight to which a gas force is applied, and a rotation center of a roller) in the roller of FIG. 5.

As shown in FIGS. 5 and 6, the roller 140 according to this embodiment is formed to have an oval shape. As the first and second torque load reducing units 145, 146 each having a predetermined volume are formed at the first and second wing portions 141, 142, a distance between a gas force weight center (C1) and the rotation center (O) of the roller (hereinafter, will be referred to as a weight center distance 'r1') can be reduced. As a result, a torque load can be reduced, and thus compression efficiency can be enhanced.

More specifically, as the roller 140 is formed to have an oval shape, the gas force weight center (C1) is moved to the first and second wing portions 141, 142 of an oval shape, when a refrigerant is compressed while the oval-shaped roller 140 is rotated in the cylinder 130 having a circular sectional shape. As a result, the gas force weight center (C1) becomes distant from the rotation center (O) of the roller 140, and a torque load (T) proportional to the weight center distance (r1) with respect to the same gas force (F) is increased. On the contrary, in this embodiment of the present invention, the first and second torque load reducing units 145, 146 are penetratingly-formed at the first and second wing portions 141, 142 in a shaft direction, or formed at the first and second wing portions 141, 142 to have a predetermined depth. As a result, the gas force weight center (C1) (the center of weight to which a gas force is applied) is moved to the rotation center (O) of the roller 140, and thus the weight center distance (r1) becomes short. Assuming that gas forces (F) in the compression spaces V1 and V2 are the same, a torque load proportional to the weight center distance (r1) is reduced, and thus an input applied to the motor part 20 with respect to the same cooling capacity is reduced. As a result, compression efficiency can be enhanced.

When the first and second torque load reducing units 145, 146 have a larger volume and are closer to the outer circumferential surface of the roller, a larger amount of torque load may be reduced as the gas force weight center (C1) is moved to the rotation center (O).

Figure 7:
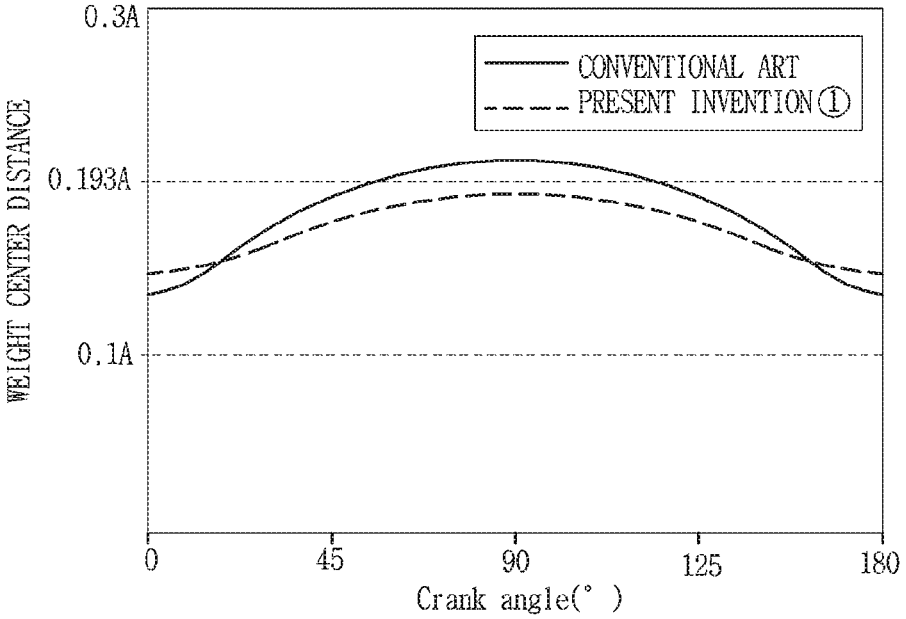
FIG. 7 is a graph illustrating a change of a weight center distance according to a crank angle, at the time of forming a torque load reducing unit without considering an inner wall surface and an outer wall surface of the torque load reducing unit.

FIG. 7 is a graph illustrating a change of a weight center distance according to a crank angle, at the time of forming a torque load reducing unit without considering an inner wall surface and an outer wall surface of the torque load reducing unit.

As shown, in the conventional art having no torque load reducing unit, the weight center distance (r) is the longest when a crank angle is 90°. On the contrary, in this embodiment, the weight center distance (r1) is the shortest when the crank angle is 90°. That is, in the conventional art having no torque load reducing unit, the weight center distance (r) corresponds to a long-axis diameter (L1) of about 0.212×a long-axis diameter of the roller when the crank angle is 90°. On the other hand, in the present invention (①), the weight center distance (r1) is about 0.0749×A. The torque load (T) is proportional to the gas force (F) and the weight center distance (r1), respectively. Accordingly, the torque is determined by the weight center distance, assuming that the gas force (F) is the same. In the present invention (①) where the torque load reducing unit is provided, a torque load can be reduced by 64.7% to the maximum, based on the same long-axis diameter (L1) of the roller, when compared with the conventional art where no torque load reducing unit is provided.

In this case, the torque load reducing units 145, 146 have the following standard. That is, a long-axis diameter (L1') of a virtual oval (ellipse) which connects outer wall surfaces 145*a*, 146*b* of the first and second torque load reducing units 145, 146 with each other, may be formed to be larger than a diameter (D) of the rotational shaft, but smaller than the long-axis diameter (L1) of the roller. And a short-axis diameter (L2') of the virtual oval (ellipse) which connects the outer wall surfaces 145*a*, 146*a* of the first and second torque load reducing units 145, 146 with each other, may be formed to be larger than the diameter (D) of the rotational shaft, but smaller than a short-axis diameter (L2) of the roller.

A long-axis distance (H) (i.e., a maximum interval) between the outer wall surface and the inner wall surface of each of the torque load reducing units 145, 146 may be formed to be larger than 0 at least, but to be smaller than a half of a value obtained by deducing the diameter (D) of the rotational shaft from the long-axis diameter (L1) of the roller.

However, since the torque load reducing units 145, 146 should be formed on an upper surface or a lower surface of the roller 140, the outer wall surfaces 145*a*, 146*a* and the inner wall surfaces 145*b*, 146*b* of the torque load reducing units may have a limitation. That is, since the torque load reducing units correspond to a dead volume, the outer wall surfaces of the torque load reducing units are preferably formed to have a predetermined sealing distance from the outer circumferential surface of the roller 140, such that a refrigerant compressed in the compression spaces V1 and V2 is prevented from being introduced into the torque load reducing units. And the inner wall surfaces 145*b*, 146*b* of the torque load reducing units 145, 146 are preferably formed to have a fixing intensity high enough to fix the rotational shaft 30 without being overlapped with the rotational shaft 30.

Figure 8:
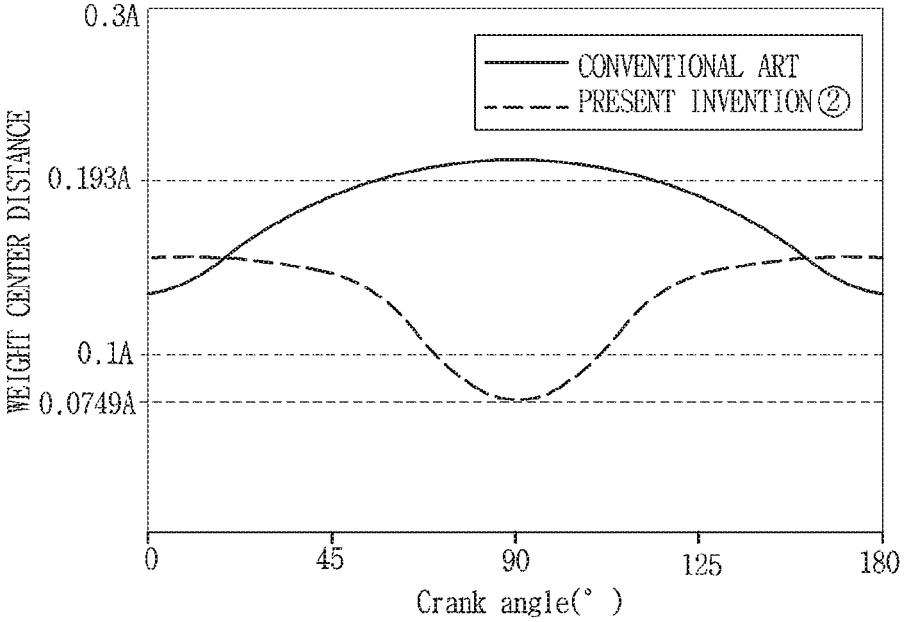
FIG. 8 is a graph illustrating a change of a weight center distance according to a crank angle, at the time of forming a torque load reducing unit with consideration of an inner wall surface and an outer wall surface of the torque load reducing unit.

FIG. 8 is a graph illustrating a change of a weight center distance according to a crank angle, at the time of forming a torque load reducing unit with consideration of the inner wall surface and the outer wall surface of the torque load reducing unit.

As shown, in the conventional art where no torque load reducing unit is provided, the weight center distance is the longest when a crank angle is 90°. However, in the present invention (②) where the torque load reducing units 145, 146 are formed with a sealing distance of about 5 mm, the weight center distance (r1) becomes very short when the crank angle is 90°. That is, in the conventional art where no torque load reducing unit is provided, a weight center distance is about 0.212×A when the crank angle is 90°. On the contrary, in the present invention (②) where the torque load reducing units 145, 146 are formed, a weight center distance is 0.193?A. The torque is determined by the weight center distance (r1), assuming that the gas force (F) is the same. In the present invention (②) where the torque load reducing unit is provided, a torque load can be reduced by 8.8% to the maximum, based on the long-axis diameter (L1) of the roller, when compared with the conventional art where no torque load reducing unit is provided.

In this case, the torque load reducing units 145, 146 have the following standard. That is, a long-axis diameter (L1') of a virtual oval (ellipse) which connects the outer wall surfaces 145*a*, 146*a* of the first and second torque load reducing units 145, 146 with each other, may be formed to be larger than or equal to a value obtained by adding the sealing distance to the diameter (D) of the rotational shaft, but smaller than or equal to a value obtained by deducting the sealing distance from the long-axis diameter (L1) of the roller. And a short-axis diameter (L2') of the virtual oval (ellipse) which connects the outer wall surfaces 145*a*, 146*a* of the first and second torque load reducing units 145, 146 with each other, may be formed to be larger than or equal to a value obtained by adding the sealing distance to the diameter (D) of the rotational shaft, but smaller than or equal to a value obtained by deducting the sealing distance from the short-axis diameter (L2) of the roller. A long-axis distance (H) between the outer wall surface and the inner wall surface of each of the torque load reducing units 145, 146 may be formed to be larger than or equal to 0 at least, but to be smaller than a half of a value obtained by deducing the sealing distance and the diameter (D) of the rotational shaft from the long-axis diameter (L1) of the roller.

Hereinafter, another embodiment of the torque load reducing units in the rotary compressor according to the present invention will be explained.

Figure 9:
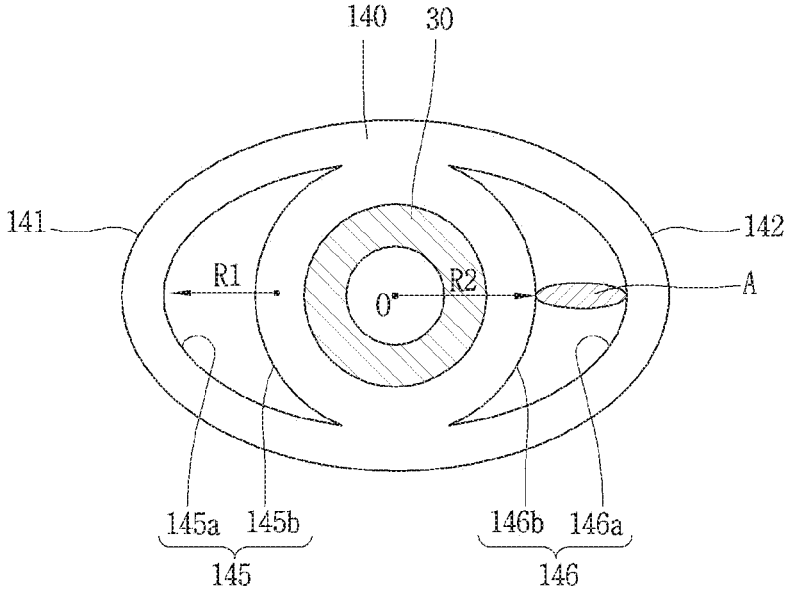
FIGS. 9 to 11 are planar views illustrating a torque load reducing unit according to another embodiment in a roller of FIG. 2.

In the aforementioned embodiment, each of the inner wall surfaces 145*b*, 146*b* of the torque load reducing units 145, 146 is formed to have a straight line shape. On the other hand, in this embodiment of the present invention, as shown in FIG. 9, the inner wall surface 145*b* may be formed to have a convex curved shape toward the outer wall surface 145*a*, considering that the first and second wing portions 141, 142 have an oval shape. In this case, a curvature radius (R2) of the inner wall surface 145*b* is preferably formed to be larger than a curvature radius (R1) of the outer wall surface 145*a*, for maximization of a long-axis direction sectional area (A) of the first torque load reducing unit 145. With such a configuration, the gas force weight center (C1) may be moved much more toward the rotation center (O) of the roller.

Hereinafter, still another embodiment of the torque load reducing units in the rotary compressor according to the present invention will be explained.

Figure 10:
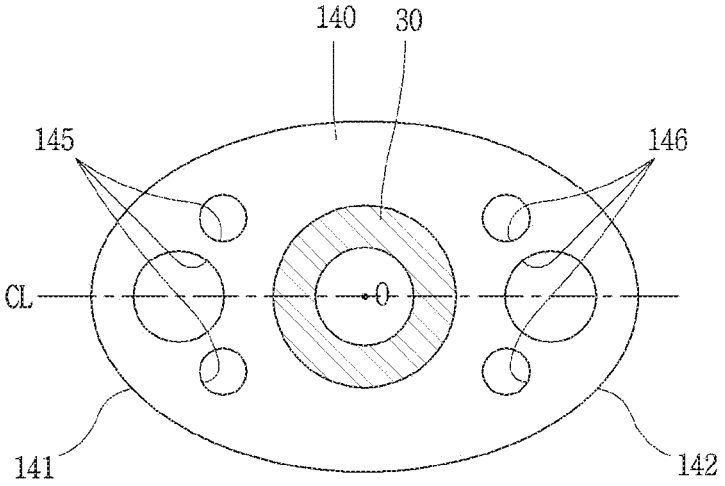

In the aforementioned embodiment, each of the torque load reducing units 145, 146 is formed at each of the wing portions in one in number. However, in this embodiment of the present invention, as shown in FIG. 10, each of the torque load reducing units 145, 146 may be formed at each of the wing portions in plurality in number. The torque load reducing units 145, 146 may be formed to have the same shape or different shapes.

In the case where each of the torque load reducing units is formed at each of the wing portions in plurality in number, a torque load reducing unit positioned on a long-axis direction central line (CL) or positioned near the long-axis direction central line (CL) is preferably formed to have a largest sectional area.

Hereinafter, still another embodiment of the torque load reducing units in the rotary compressor according to the present invention will be explained.

Figure 11:
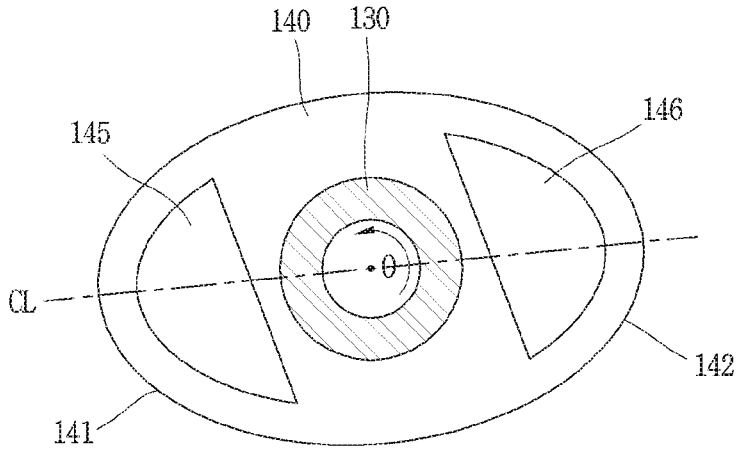

In the aforementioned embodiments, the torque load reducing units are formed to be symmetrical to each other, on the basis of the long-axis direction central line (CL) which connects central parts of the two wings to each other. However, in this embodiment, as shown in FIG. 11, the torque load reducing units 145, 146 may be formed to be asymmetrical to each other, on the basis of the long-axis direction central line (CL). In this case, the torque load reducing units 145, 146 are preferably positioned at a front side of the long-axis direction central line (CL), assuming that a rotation direction of the roller based on the long-axis direction central line (CL) is towards the front side.

For reduction of vibrations of the compressor, the torque load reducing units 145, 146 are preferably formed to be point-symmetrical to each other, based on the rotation center (O) of the roller.

Although not shown, the roller and the rotational shaft may be formed of different materials, and the roller may be formed to have a lower density than the rotational shaft. In this case, as a weight center distance of the roller is reduced, a torque load can be reduced.

What is claimed is:

1. A compressor, comprising:

a driving motor;

a rotational shaft configured to transmit a rotational force of the driving motor;

a cylinder installed at one side of the driving motor, the cylinder having a first suction opening and a second suction opening penetrating in a radial direction, respectively;

a roller having an outer circumferential surface contacting an inner circumferential surface of the cylinder at at least two points, rotated by the rotational shaft, and concentric with the cylinder; and at least two vanes movably provided at the cylinder, contacting the outer circumferential surface of the roller, and configured to divide at least two compression spaces formed by the cylinder and the roller into a suction chamber and a compression chamber, wherein the roller is provided with a plurality of torque load reducing units configured to move a center of weight to which a gas force is applied by the roller, wherein the plurality of torque load reducing units is formed, respectively, at two sides of a short-axis direction central line of the roller, wherein the short-axis direction central line is perpendicular to a long-axis direction central line of the roller at a rotation center, wherein the long-axis direction center line connects a plurality of contact points between the outer circumferential surface of the roller and the inner circumferential surface of the cylinder with each other, wherein the plurality of torque load reducing units is formed as holes which penetrate the roller in a shaft direction or grooves formed at upper and lower side surfaces of the roller having a predetermined depth, and the plurality of torque load reducing units is at least partially positioned on the long-axis direction central line of the roller, wherein the plurality of torque load reducing units each includes an outer wall surface formed to have a curved surface, and an inner wall surface that connects two ends of the outer wall surface, wherein the outer wall surface of each torque load reducing unit is spaced from the outer circumferential surface of the roller by a predetermined sealing distance, wherein the outer wall surface of each torque load reducing unit is formed to have a same curvature as the outer circumferential surface of the roller so that the predetermined sealing distance is the same in a circumferential direction, wherein the inner wall surface of each torque load reducing unit is formed to have a straight line shape or a convex curved shape toward the outer wall surface and a curvature radius of the inner wall surface is larger than a curvature radius of the outer wall surface, wherein the plurality of torque load reducing units is formed to be asymmetrical to each other, based on the long-axis direction central line of the roller, and wherein the plurality of torque load reducing units is formed such that a geometrical center of each of the plurality of torque load reducing units is positioned at a front side of the long-axis direction central line of the roller, assuming that a rotational direction of the roller based on the long-axis direction central line is toward the front side, and a front end of each of the plurality of torque load reducing units communicates with the suction chamber to allow a portion of oil received therein and having a relatively high pressure to be introduced into the suction chamber to thereby lubricate a bearing surface between the outer circumferential surface of the roller and the inner circumferential surface of the cylinder.

2. The compressor of claim 1, wherein a long-axis diameter of a virtual oval which connects two ends of the outer wall surface of the plurality of torque load reducing units with each other, is formed to be larger than a diameter of the rotational shaft, but smaller than a long-axis diameter of the roller.

3. The compressor of claim 1, wherein a long-axis diameter of each torque load reducing unit is formed to be larger than or equal to a value obtained by adding the predetermined sealing distance to a diameter of the rotational shaft, but smaller than or equal to a value obtained by deducting the predetermined sealing distance from a long-axis diameter of the roller.

4. The compressor of claim 1, wherein a short-axis diameter of a virtual oval which connects two ends of the outer wall surface of the plurality of torque load reducing units with each other, is formed to be larger than a diameter of the rotational shaft, but smaller than a short-axis diameter of the roller.

5. The compressor of claim 4, wherein a short-axis diameter of each torque load reducing unit is formed to be larger than or equal to a value obtained by adding the predetermined sealing distance to the diameter of the rotational shaft, but smaller than or equal to a value obtained by deducting the predetermined sealing distance from the short-axis diameter of the roller.

6. The compressor of claim 1, wherein a maximum interval between the outer wall surface and the inner wall surface of each torque load reducing unit is formed to be larger than zero, but to be smaller than a half of a value obtained by deducting a diameter of the rotational shaft from a long-axis diameter of the roller.

7. The compressor of claim 6, wherein a maximum interval between the outer wall surface and the inner wall surface of the torque load reducing unit is formed to be larger than zero, but to be smaller than or equal to a half of a value obtained by deducting the predetermined sealing distance and the diameter of the rotational shaft from the long-axis diameter of the roller.

8. The compressor of claim 1, wherein the plurality of torque load reducing units is configured to move the center of weight to which the gas force is applied, toward the rotation center of the roller, and wherein the long-axis direction central line of the roller which connects two contact points of the roller contacting the inner circumferential surface of the cylinder is perpendicular to a virtual line which connects a lengthwise central line of the two vanes, and a distance between a geometrical center of each torque load reducing unit and the rotation center is equal to or larger than a distance between the center of weight and the rotation center.

9. The compressor of one of claim 1, wherein the long-axis direction central line of the roller which connects two contact points of the roller contacting the inner circumferential surface of the cylinder is perpendicular to a virtual line which connects a lengthwise central line of the two vanes, and a distance between the center of weight to which the gas force is applied by the roller and the rotation center of the roller is larger than or equal to (0.0749×a long-axis diameter of the roller), but smaller than or equal to (0.212×the long-axis diameter of the roller).

10. The compressor of claim 1, wherein the roller and the rotational shaft are formed of different materials, and the roller is formed to have a lower density than the rotational shaft.

11. A compressor, comprising:

a driving motor;

a rotational shaft configured to transmit a rotational force of the driving motor;

a cylinder installed at one side of the driving motor, the cylinder having a first suction opening and a second suction opening penetrating in a radial direction, respectively;

a roller having an outer circumferential surface contacting an inner circumferential surface of the cylinder at at least two points, rotated by the rotational shaft, and concentric with the cylinder; and at least two vanes movably provided at the cylinder, contacting the outer circumferential surface of the roller, and configured to divide at least two compression spaces formed by the cylinder and the roller into a suction chamber and a compression chamber, wherein the roller is provided with a plurality of torque load reducing units configured to move a center of weight to which a gas force is applied by the roller, wherein the plurality of torque load reducing units is formed, respectively, as holes which penetrate the roller in a shaft direction or grooves formed at upper and lower side surfaces of the roller having a predetermined depth, wherein the plurality of torque load reducing units each includes an outer wall surface formed to have a curved surface, and an inner wall surface to connect two ends of the outer wall surface, wherein the outer wall surface of each torque load reducing unit is spaced from the outer circumferential surface of the roller by a predetermined sealing distance, wherein the outer wall surface of each torque load reducing unit is formed to have a same curvature as the outer circumferential surface of the roller, and the inner wall surface of each torque load reducing unit is formed to have a straight line shape or a convex curved shape toward the outer wall surface, wherein the plurality of torque load reducing units is formed to be asymmetrical to each other, based on a long-axis direction central line of the roller, the long-axis direction central line connecting a plurality of contact points between the outer circumferential surface of the roller and the inner circumferential surface of the cylinder with each other, and wherein the plurality of torque load reducing units is formed such that a geometrical center of each of the plurality of torque load reducing units is positioned at a front side of the long-axis direction central line of the roller, assuming that a rotational direction of the roller based on the long-axis direction central line is toward the front side, and a front end of each of the plurality of torque load reducing units communicates with the suction chamber to allow a portion of oil received therein and having a relatively high pressure to be introduced into the suction chamber to thereby lubricate a bearing surface between the outer circumferential surface of the roller and the inner circumferential surface of the cylinder.

12. The compressor of claim 11, wherein the plurality of torque load reducing units is formed at two sides of a short-axis direction central line of the roller, wherein the short-axis direction central line is perpendicular to a long-axis direction central line of the roller at a rotation center, and wherein the long-axis direction center line connects a plurality of contact points between the outer circumferential surface of the roller and the inner circumferential surface of the cylinder with each other.

13. The compressor of claim 11, wherein the plurality of torque load reducing units is formed to be positioned on the long-axis direction central line of the roller at least partially.

* * * * *